US008159139B2

(12) United States Patent
Blaut et al.

(10) Patent No.: US 8,159,139 B2
(45) Date of Patent: Apr. 17, 2012

(54) COLOR AND INTENSITY CONTROL OVER POWER WIRES

(75) Inventors: Roni Blaut, Netanya (IL); Alon Ferentz, Bat Yam (IL)

(73) Assignee: Microsemi Corp.—Analog Mixed Signal Group Ltd., Hod Hasharon (IL)

( * ) Notice: Subject to any disclaimer, the term of this patent is extended or adjusted under 35 U.S.C. 154(b) by 498 days.

(21) Appl. No.: 12/550,428

(22) Filed: Aug. 31, 2009

(65) Prior Publication Data

US 2010/0072903 A1 Mar. 25, 2010

Related U.S. Application Data

(60) Provisional application No. 61/099,915, filed on Sep. 25, 2008.

(51) Int. Cl.
*H05B 41/00* (2006.01)

(52) U.S. Cl. ..... 315/185 R; 315/291; 315/311

(58) Field of Classification Search ..... 315/185 R–193, 315/291, 299–300, 307, 311
See application file for complete search history.

(56) References Cited

U.S. PATENT DOCUMENTS 4,547,712 A * 10/1985 Gotal et al. ..... 318/128
4,716,409 A 12/1987 Hart et al.
4,719,446 A 1/1988 Hart
4,990,908 A 2/1991 Tung
5,189,412 A 2/1993 Mehta et al.
5,327,047 A * 7/1994 Gershen ..... 315/194
5,365,154 A 11/1994 Schneider et al.
5,511,943 A 4/1996 Chang
5,629,607 A 5/1997 Callahan et al.
6,120,262 A 9/2000 McDonough et al.
2009/0160627 A1 6/2009 Godbole
2010/0060187 A1 * 3/2010 Newman et al. ..... 315/291

OTHER PUBLICATIONS

AN-916 Application Note—Analog Devices, Norwood MA, 2008.
AN302 Application Note—STMicroelectronics, Geneva, Switzerland, Mar. 2008.
ADE75xx/ADE71xx—Preliminary Technical Data Sheet—Analog Devices, Norwood MA, Jan. 2007.

* cited by examiner

*Primary Examiner* — James H Cho
(74) *Attorney, Agent, or Firm* — Simon Kahn

(57) ABSTRACT

A control element for a luminaire constituted of a first and a second manually variable non-momentary impedance and a first and a second time dependent gating circuit, each responsive to a respective manually variable non-momentary impedance and operative to provide a time dependent gating of a respective polarity of an alternating current power signal, the amount of time of the gating reflecting the present value of the respective manually variable non-momentary impedance, wherein the first time dependent gating circuit and the second time dependent gating circuit are restrained to maintain a minimum predetermined power towards the solid state lighting unit.

20 Claims, 2 Drawing Sheets

COLOR AND INTENSITY CONTROL OVER POWER WIRES

CROSS-REFERENCE TO RELATED APPLICATION

This application claims priority from U.S. Provisional Patent Application Ser. No. 61/099,915 filed Sep. 25, 2008, entitled "Color and Intensity Control Over Power Wires", the entire contents of which is incorporated herein by reference.

TECHNICAL FIELD

The present invention relates to the field of LED colored lighting, and particularly to a method and apparatus for controlling both color and intensity over standard AC power carrying wires.

BACKGROUND

Solid state lighting is rapidly expanding its penetration, bringing to the market increased lighting efficiency, longer life and additional capabilities. One example of solid stage lighting is the use of light emitting diodes (LEDs), which are available in a plurality of colors. By combining the optical output of a plurality of colored LEDs a range of colors may be output. In one non-limiting example, the use of red, green and blue LEDs placed in proximity and behind a diffuser enables a complete range of colors by adjusting the relative intensity of the constituent LEDs, while the overall intensity of the constituent LEDs may be further adjusted to control the average overall luminance.

In order to economically control a large plurality of LEDs together producing sufficient light, the LEDs are typically supplied as a serially connected LED string, thereby sharing a single current. Each of the LED strings may be intensity controlled by one or both of amplitude modulation (AM), in which the value of the current through the LED string is adjusted, and pulse width modulation (PWM) in which the duty rate is controlled to adjust the average intensity over time. Thus, total intensity and color may be controlled by any combination of AM and PWM.

Solid state lighting exhibiting the ability to produce a plurality of colors over a range of intensities is preferably provided with a control unit arranged to enable user selection of both intensity and color. In a typical domestic arrangement, such a control unit is preferably arranged to be installed without requiring a professional electrician at a user convenient location; typically replacing an existing switch or dimmer. Such an arrangement limits communication between the control unit and the solid stage lighting unit to be over existing power wires or to be wireless. The use of wireless communication is often inconvenient due to interferences or increased cost, and similarly the use of communication over power wires is expensive.

SUMMARY

In view of the discussion provided above and other considerations, the present disclosure provides methods and apparatus to overcome some or all of the disadvantages of prior and present color and intensity control methods and apparatuses. Other new and useful advantages of the present methods and apparatus will also be described herein and can be appreciated by those skilled in the art.

This is provided in certain embodiments by a control unit and a lighting unit interconnected over standard AC power delivering wires. The control unit exhibits separate phase control over each of the positive and negative portions of the AC cycle. Phase control over a first one of the positive and negative portions represents control of the intensity, and phase control over a second one of the positive and negative portions represents control over the color. In one embodiment a pair of independently controlled silicon controlled rectifiers (SCR) are used, with a first of the pair of SCRs providing phase control over the positive portion of the AC cycle, and a second of the pair of SCRs providing phase control over the negative portion of the AC cycle. The phase controls are preferably constrained so as to deliver the required operating power towards the lighting unit.

The lighting unit is provided with a phase detection unit operative separately on the positive portion of the AC cycle and the negative portion of the AC cycle. In one embodiment the phase detection unit is implemented via an energy meter circuit. Responsive to the phase information, intensity and color information are derived. The derived intensity and color information are used to drive the resulting solid state lighting, which in one particular embodiment is implemented by colored LED strings.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF PREFERRED EMBODIMENTS

Figure 1:
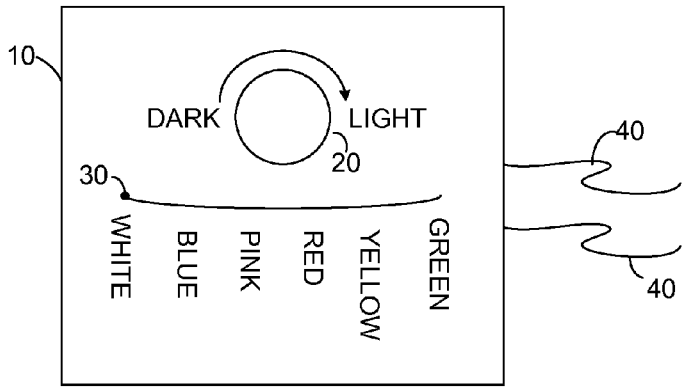
FIG. 1 illustrates a high level schematic diagram of an intensity and color control element for a luminaire according to an exemplary embodiment.

Before explaining at least one embodiment in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting. The term connected as used herein is not meant to be limited to a direct connection, and the use of appropriate resistors, capacitors and inductors does not exceed the scope thereof.

FIG. 1 illustrates a high level schematic diagram of an intensity and color control element 10 comprising a rotatable knob 20, a sliding control 30 and a pair of wires 40. Each wire of pair of wires 40 is connected at a first end to intensity and color control element 10 and at a second end to a lighting unit as will be described below in relation to FIG. 2. Rotatable knob 20 is operative to control light intensity output by a luminaire of the lighting unit and in one embodiment is marked to show in which direction it should be turned so as to raise or lower the resultant light intensity. Sliding control 30 is operative to control the color of the light output of the luminaire of the lighting unit and in one embodiment is marked with a range of colors to show the appropriate position for sliding control 30 so as to achieve each of a plurality of pre-determined colors for the luminaire output.

In operation, rotatable knob 20 is turned clockwise or counter-clockwise so as to adjust intensity and sliding control 30 is slid left or right so as to adjust color. In one embodiment, slider 30 exhibits a plurality of detents, each of the detents associated with a particular predetermined color.

The above has been described in relation to an embodiment in which intensity is controlled by a rotatable knob and color is controlled by a sliding control, however this is not meant to be limiting in any way. In another embodiment, intensity is controlled by a sliding control and color is controlled by a rotatable knob. In yet another embodiment, both color and intensity are controlled by a pair of either rotatable knobs or sliding controls.

Figure 2:
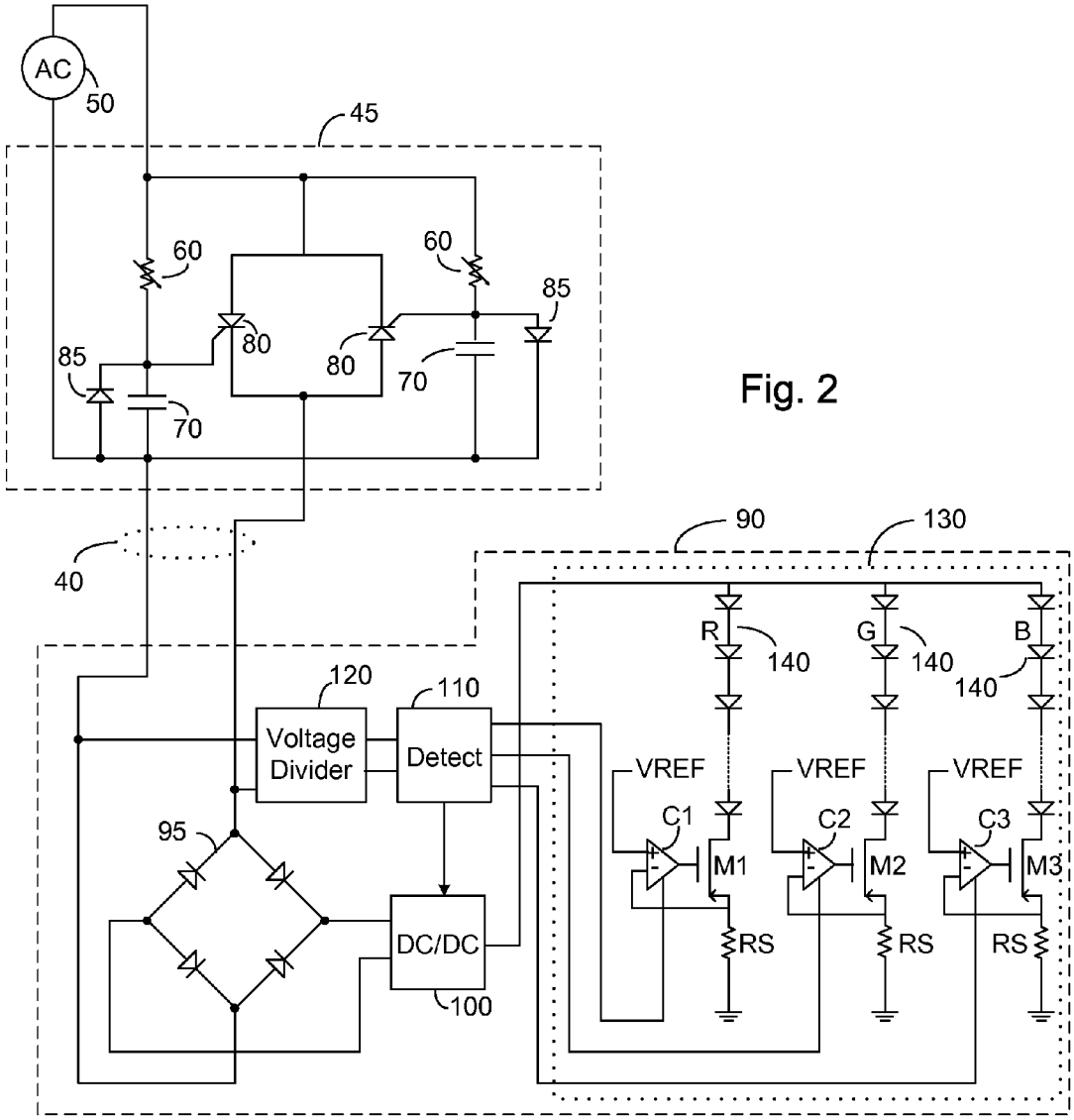
FIG. 2 illustrates a high level schematic diagram of a control unit and a lighting unit connected over standard AC power carrying wires according to an exemplary embodiment.

FIG. 2 illustrates a high level schematic diagram, according to an exemplary embodiment, of a control unit 45, a source of AC power 50 and a lighting unit 90, wherein control unit 45 is connected to lighting unit 90 over a pair of AC power carrying wires 40. Control unit 45, which in one embodiment is housed collocated with intensity and control color element 10 of FIG. 1, comprises a first and a second variable resistor 60, a first and a second capacitor 70, a first and a second thyristor 80, and a first and a second protection diode 85. In one optional embodiment (not shown) an interference suppression filter is further supplied. Lighting unit 90 comprises a full-wave rectifier 95, a direct current to direct current (DC to DC) converter 100, a detector 110, a voltage divider network 120, and a luminaire 130. Luminaire 130 comprises a plurality of light emitting diode (LED) strings 140, a plurality of field effect transistors (FET) denoted M1, M2 and M3 respectively, a plurality of sense resistors, each denoted RS and associated with a particular one of the plurality of FETs M1, M2, M3, and a plurality of comparators denoted C1, C2 and C3 respectively, each associated with a particular one of the plurality of FETs M1, M2, M3. In one embodiment the plurality of LED strings 140 are each constituted of a colored LED string, preferably selected from among the three base colors, red, green and blue, denoted R,G and B respectively. Light from the constituent colored LED strings 140 is mixed to produce a combined color. First and second thyristors 80 are preferably each implemented as reverse blocking triode thyristors, more commonly known as a silicon controlled rectifier (SCR).

First variable resistor 60 is associated with a first one of rotatable knob 20 of FIG. 1 and sliding control 30 of FIG. 1, and second variable resistor 60 is associated with a second one of rotatable knob 20 of FIG. 1 and sliding control 30 of FIG. 1. For simplicity, and ease of understanding, first variable resistor 60 will be described as being associated with rotatable knob 20 of FIG. 1, controlled responsive to rotation thereof, and associated with the positive phase portion of the AC sine wave of source of AC power 50; and second variable resistor 60 will be described as being associated with sliding control 30 of FIG. 1, controlled responsive to the slideably set location thereof and associated with the negative phase portion of the AC sine wave of source of AC power 50, however this is not meant to be limiting in any way.

The phase side of source of AC power 50 is connected to the anode of first thyristor 80, the cathode of second thyristor 80, and a first end of each of first variable resistor 60 and second variable resistor 60. The cathode of first thyristor 80 is connected to a first end of a first wire of AC power carrying wires 40 and to the anode of second thyristor 80. The neutral side of source of AC power 50 is connected to a first end of each of first and second capacitor 70, the anode of first protection diode 85, the cathode of second protection diode 85, and a first end of second wire of AC power carrying wires 40. The gate of first thyristor 80 is connected to the second end of first variable resistor 60, to the second end of first capacitor 70 and to the cathode of first protection diode 85. In one optional embodiment (not shown) the gate of first thyristor 80 is connected to first variable resistor 60, first capacitor 70 and first protection diode 85 via a silicon bilateral switch having a specific breakover voltage. The gate of second thyristor 80 is connected to the second end of second variable resistor 60, to the second end of second capacitor 70 and to the anode of second protection diode 85. In one optional embodiment (not shown) the gate of second thyristor 80 is connected to second variable resistor 60, second capacitor 70 and second protection diode 85 via a silicon bilateral switch having a specific breakover voltage.

A second end of the first wire of AC power carrying wires 40 is connected to a first input of voltage divider network 120 and to a first input of full-wave rectifier 95. A second end of the second wire of AC power carrying wires 40 is connected to a second input of voltage divider network 120 and to a second input of full-wave rectifier 95. A first output of voltage divider network 120 is connected to a first input of detector 110 and a second output of voltage divider network 120 is connected to a second input of detector 110. The positive output of full-wave rectifier 95 is connected to a first input of DC to DC converter 100 and the negative output of full-wave rectifier 95 is connected to a second input of DC to DC converter 100. A first output of detector 110 is connected to the control input of DC to DC converter 100.

A first end of each of LED strings 140 is connected to the output of DC to DC converter 100, and a second end of each LED string 140 is connected to the drain of the associated FET, i.e. to the associated one of FETs M1, M2, and M3. The source of each of FETs M1, M2, and M3 are connected to the inverting input of a respective one of comparators C1, C2 and C3, and to a first end of a respective sense resistor RS. A voltage reference signal, denoted VREF, is connected to the non-inverting input of each of comparators C1, C2 and C3. A single VREF value is illustrated, however this is not meant to be limiting in any way, and in another embodiment a separate voltage reference signal is supplied for each of the non-inverting inputs of comparators C1, C2 and C3. The output of each of comparators C1, C2 and C3 is connected to the gate of the respective FET M1, M2 and M3. A second end of each sense resistor RS is connected to a common point, in one embodiment the common point being a ground potential. A particular output of detector 110 is connected to an enable input of each of comparators C1, C2 and C3.

Detector 110 may be powered by a number of sources, including, but not limited to an output of DC to DC converter 100, an internal power source, and a voltage reference connected across the outputs of full wave rectifier 95. Voltage divider 120 is operative to reduce the voltage appearing across pair of AC power carrying wires 40 to a voltage appropriate for the input of detector 110. Detector 110 comprises a phase detection unit operative separately on the positive portion of the AC cycle and the negative portion of the AC cycle. In one embodiment the phase detection unit is implemented via an energy meter circuit as part of a CPU.

In operation, if an adjustment in luminance intensity is desired, rotatable knob 20 of FIG. 1 is rotated to the desired point. The rotation of rotatable knob 20 changes the resistance of first variable resistor 60 thereby changing the charging rate of first capacitor 70. The charge across first capacitor 70 defines a time dependent gating of the positive phase of AC power passed by first thyristor 80, since first thyristor 80 is triggered once the charge across first capacitor 70 passes a predetermined value. The resistance of first variable resistor 60 preferably cannot be lowered beneath a predetermined resistance, so as to ensure sufficient power towards lighting unit 90. The output of source of AC power 50 is a sine wave, and when the instantaneous voltage of the positive phase has charged first capacitor 70 through first variable resistor 60 to a sufficient voltage, first thyristor 80 is triggered. The positive portion of the AC cycle is thus gated, responsive to the resistance value of first variable resistor 60, only a fraction of it exiting control unit 45. Power will continue to flow through first thyristor 80 until the end of the positive phase of the sine wave, when the flow of current is reduced to below a predetermined value, resulting in shut down of first thyristor 80.

If an adjustment in color of the light output of luminaire 130 is desired, sliding control 30 of FIG. 1 is slid to the desired point. The position of sliding control 30 changes the resistance of second variable resistor 60 thereby changing the charging rate of second capacitor 70. The charge across second capacitor 70 defines a time dependent gating of the negative phase of AC power passed by second thyristor 80, since second thyristor 80 is triggered once the charge across second capacitor 70 passes a predetermined value. The resistance of second variable resistor 60 preferably cannot be lowered beneath a predetermined resistance, so as to ensure sufficient power towards lighting unit 90. The output of source of AC power 50 is a sine wave, and when the instantaneous voltage of the negative phase has charged second capacitor 70 through second variable resistor 60 to a sufficient voltage, second thyristor 80 is triggered. The negative portion of the AC cycle is thus gated, responsive to the resistance value of second variable resistor 60, only a fraction of it exiting control unit 45. Power will continue to flow through second thyristor 80 until the end of the negative phase of the sine wave, when the flow of current is reduced to below a predetermined value, resulting in shut down of second thyristor 80.

The above has been described in relation to a time dependent gating of the beginning of each of the positive and negative phases, however this is not meant to be limiting in any way, and is particularly meant to include trailing edge gating and proportional phase gating without exceeding the scope.

Time gated power is transferred via AC power carrying wires 40 and appears across full wave rectifier 95. Power is supplied to luminaire 130 via full wave rectifier 95 and DC to DC converter 100.

A divided portion of the time gated power further appears across detector 110 via voltage divider 120. Detector 110 is operative to detect the amount of gating of each of positive and negative phases of the AC power signal, and responsive thereto controls the intensity and color of the light output by luminaire 130. In particular, in one embodiment, the amount of gating of the first polarity is representative of the setting of first variable resistor 60, which reflects the setting of rotatable knob 20, and the amount of gating of the second polarity, opposing the first polarity, is representative of the setting of second variable resistor 60, which reflects the position of sliding control 30. In one embodiment the intensity of the output of luminaire 130 is adjusted by varying the voltage output of DC to DC converter 100, and the color is adjusted by pulse width modulating each of FETs M1, M2, and M3 by toggling the enable input of the respective comparators C1, C2 and C3 to result in the desired color output. The above has been described in an embodiment in which detector 110 is operative to both detect the amount of gating and further control the intensity and color of the output of luminaire 130, however this is not meant to be limiting in any way. In another embodiment (not shown) the outputs of detector 110 representing the detected amounts of gating for each phase are input to a separate controller, and the separate controller is operative to control the intensity and color of the output of luminaire 130 responsive to the received detected amounts of gating for each phase.

Comparators C1, C2 and C3 are each operative to compare the voltage representation of the current running through respective one of LED strings 140 with the respective reference voltage VREF. If the voltage representation of the current rises and approaches reference voltage VREF, i.e. the current flow is nearing the amount reflected by VREF, the resistance of respective FET M1, M2 or M3 is increased to compensate.

In another embodiment (not shown), the output of DC to DC converter 100 is set to a minimum required operating voltage for each of the LED strings 140, and both the intensity and color is adjusted by pulse width modulating each of the respective LED strings 140 via the enable input of the respective comparators C1, C2 and C3. In yet another embodiment, the respective values of VREF are connected to outputs of detector 110, which is operative to set the respective current flows through each of LED strings 140 by adjusting the respective VREF values.

The above has been described in an embodiment in which knob 20 and slider 30 of FIG. 1 are controlled by continuously variable resistors 60, however this is not meant to be limiting in any way. In another embodiment one or each of knob 20 and slider 30 is controlled by a switch having a plurality of resistance settings without exceeding the scope.

Figure 3:
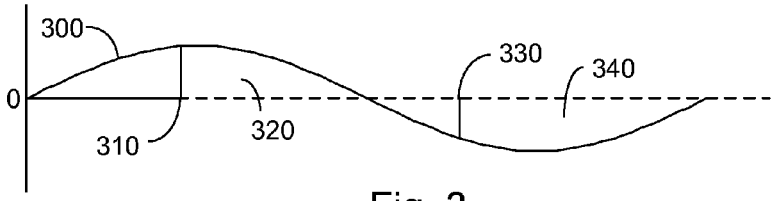
FIG. 3 is a graph illustrating the operation of the control unit of FIG. 2 according to an exemplary embodiment.

FIG. 3 is a graph illustrating the operation of control unit 45 of FIG. 2 in which the x-axis represents time and the y-axis represents voltage amplitude received by lighting unit 90. Curve 300 represents the AC power received from source of AC power 50, and is essentially a pure sine wave. Line 310 represents time dependent gating of the positive polarity of curve 300 achieved responsive to the present setting of first variable resistor 60, and area 320 represents the portion of the positive phase of curve 300 for which power is received by lighting unit 90. Line 330 represents time dependent gating of the negative polarity of the curve 300 achieved responsive to the present setting of second variable resistor 60, and area 340 represents the portion of the negative phase of curve 300 for which power is received by lighting unit 90. Preferably, the minimum values of first and second variable resistors 60 are selected such that the combination of areas 320 and 340 represents sufficient power to light luminaire 130 at the desired intensity level. Thus, in one embodiment, the range of area 340, representing the desired color, is limited so as to be at least a predetermined value so as to supply sufficient energy to power luminaire 90 over the full range of desired intensity. The allowable range of area 320 may be controlled so as to be at least a predetermined minimum value sufficient to power luminaire 90 at the intensity level represented by the position of line 310.

Figure 4:
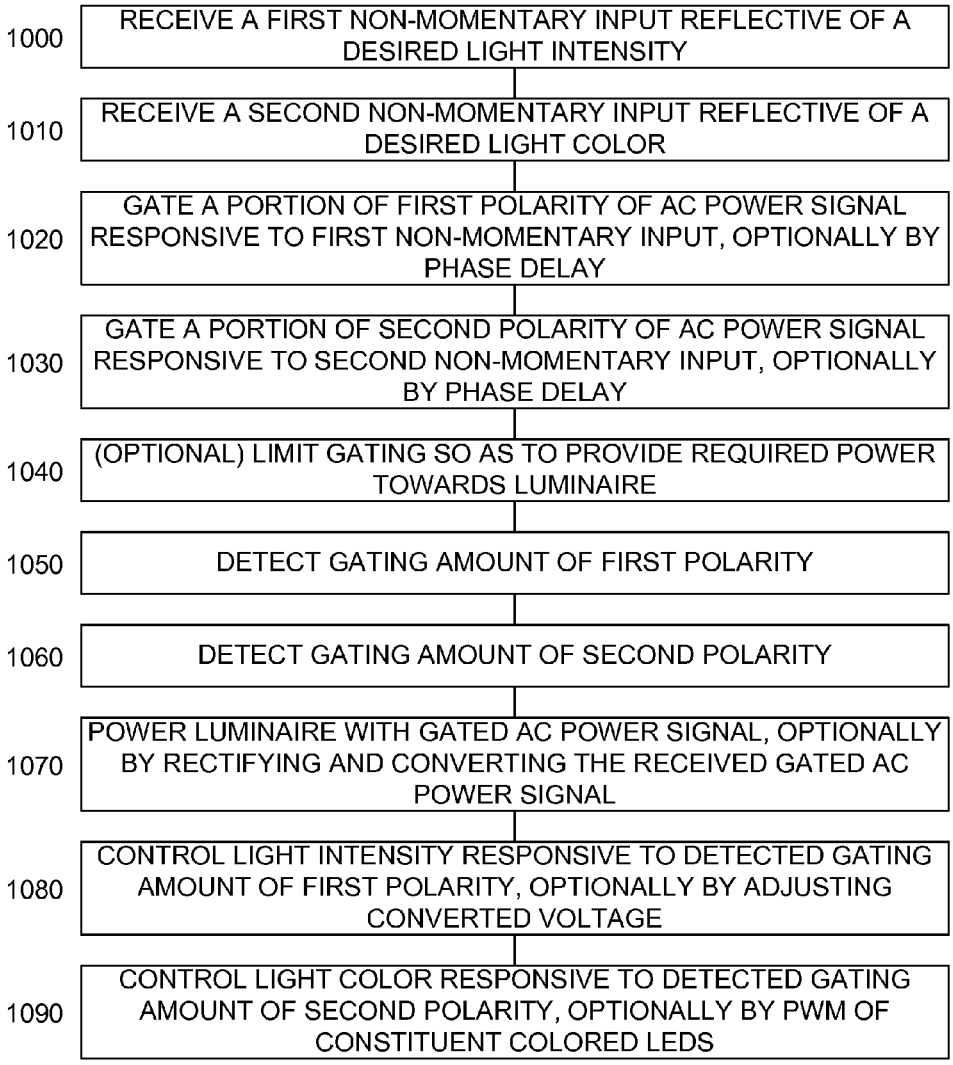
FIG. 4 illustrates a high level flow chart of a method of controlling light intensity and color output of a luminaire according to an exemplary embodiment.

FIG. 4 illustrates a high level flow chart of a method of controlling light intensity and color output of a luminaire, such as luminaire 130, according to an exemplary embodiment. In stage 1000 a non-momentary input reflective of a desired light intensity to be output by the luminaire is received, such as the setting of first variable resistor 60. In stage 1010 a non-momentary input reflective of a desired color output by the luminaire is received, such as the setting of second variable resistor 60.

In stage 1020 a portion of a first polarity of an alternating current power signal is gated, responsive to the received input of stage 1000. Optionally, the gating is by phase delaying the signal, particularly by blocking the flow of the AC power signal until the voltage exceeds a threshold determined responsive to the received input. In stage 1030 a portion of a second polarity of the alternating current power signal is gated, responsive to the received input of stage 1010. Optionally, the gating is by phase delaying the signal, particularly by blocking the flow of the AC power signal until the voltage exceeds a threshold determined responsive to the received input.

In optional stage 1040, the gating of at least one of stage 1020 and stage 1030 is limited to a predetermined amount so as to provide a minimum amount of power to the luminaire. In one non-limiting embodiment the gating of stage 1030 is particularly limited to allow for sufficient power for the range of intensities of stage 1020.

In stage 1050, the gated AC power signal of stages 1020-1040 is received, and the gating amount of the first polarity is detected. In stage 1060, the gating amount of the second polarity is detected. In stage 1070, the luminaire is powered with the gated AC power signal. Optionally the gated signal is rectified to produce a direct current signal having a first voltage and converted to a direct current signal with a second voltage appropriate for the luminaire.

In stage 1080, the light intensity output by the luminaire is controlled responsive to the detected gating amount of stage 1050. Optionally, the light intensity is controlled by adjusting the converted voltage of the optional portion of stage 1070 responsive to the detected gating amount of stage 1050.

In stage 1090, the color of the light output of the luminaire is controlled responsive to the detected gating amount of stage 1060. Optionally, the color is controlled by pulse width modulation of the constituent colored LEDs to produce the desired light color as a mix of the colors of the constituent LEDs.

Thus the present embodiments enable a color and intensity control method and apparatus for a luminaire, comprising a control unit and a lighting unit interconnected over standard AC power delivering wires. The control unit exhibits separate phase control over each of the positive and negative portions of the AC cycle. Phase control over a first one of the positive and negative portions represents control of the intensity, and phase control over a second one of the positive and negative portions represents control over the color. The phase controls are preferably constrained so as to deliver the required operating power towards the lighting unit.

The lighting unit is provided with a phase detection unit operative separately on the positive portion of the AC cycle and the negative portion of the AC cycle. In one embodiment the phase detection unit is implemented via an energy meter circuit. Responsive to the phase information, intensity and color information are derived. The derived intensity and color information are used to drive the resulting solid state lighting, which in one particular embodiment is implemented by colored LED strings.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable subcombination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described hereinabove. Rather the scope of the present invention is defined by the appended claims and includes both combinations and subcombinations of the various features described hereinabove as well as variations and modifications thereof which would occur to persons skilled in the art upon reading the foregoing description and which are not in the prior art.

We claim:

1. A control element for a luminaire, the control element arranged to be connected to the luminaire unit over a pair of wires carrying an alternating current power signal, the control comprising:

a first manually variable non-momentary impedance;

a second manually variable non-momentary impedance;

a first time dependent gating circuit, responsive to said first manually variable non-momentary impedance, arranged to provide a time dependent gating of a first polarity of the alternating current power signal, the amount of time of said gating of said first polarity reflecting the present value of said first manually variable non-momentary impedance; and a second time dependent gating circuit, responsive to said second manually variable non-momentary impedance, arranged to provide a time dependent gating of a second polarity of the alternating current power signal, said second polarity opposite said first polarity, the amount of time of said gating of said second polarity reflecting the present value of said second manually variable non-momentary impedance, wherein said first time dependent gating circuit and said second time dependent gating circuit are restrained to maintain a minimum predetermined power towards the luminaire.

2. A control element according to claim 1, wherein said first manually variable non-momentary impedance is associated with a target brightness and said second manually variably non-momentary impedance is associated with a target color.

3. A control element according to claim 1, wherein said first time dependent gating circuit comprises a thyristor.

4. A control element according to claim 1, wherein said second time dependent gating circuit comprises a thyristor.

5. A lighting and control system, comprising:

a control element comprising:

a first manually variable non-momentary impedance;

a second manually variable non-momentary impedance;

a first time dependent gating circuit responsive to said first manually variable non-momentary impedance and arranged to provide a time dependent gating of a first polarity of an alternating current power signal, the amount of time of said gating of said first polarity reflecting the present value of said first manually variable non-momentary impedance; and a second time dependent gating circuit responsive to said second manually variable non-momentary impedance and arranged to provide a time dependent gating of a second polarity of the alternating current power signal, said second polarity opposite said first polarity, the amount of time of said gating of said second polarity reflecting the present value of said second manually variable non-momentary impedance; and a lighting unit arranged to be powered from the gated alternating current power signal over a pair of power carrying wires, said lighting unit comprising:

a detector arranged on each of said first polarity and said second polarity to output a representation of said present value of said first and said second manually variable non-momentary impedance, respectively; and a luminaire exhibiting a variable output light intensity and color responsive to said detector, wherein the intensity of the light output of said luminaire is thus reflective of the present value of said first variable non-momentary impedance and the color output of said luminaire is thus reflective of the present value of said second variable non-momentary impedance, and wherein said first time dependent gating circuit and said second time dependent gating circuit are restrained to maintain a minimum predetermined power towards said lighting unit.

6. A lighting and control system according to claim 5, wherein said lighting unit further comprises a direct current to direct current converter exhibiting an output voltage, said output voltage responsive to said detector to thereby adjust said light intensity of said luminaire.

7. A lighting and control system according to claim 6, wherein said luminaire comprises a plurality of light emitting diode strings arranged to receive power from said direct current to direct current converter, each of said plurality of light emitting diode strings outputting light of a particular one of a plurality of colors, said color output of said luminaire comprising a mix of the color outputs of said plurality of light emitting diode strings.

8. A lighting and control system according to claim 7, wherein each of said plurality of light emitting diode strings is respectively pulse width modulated responsive to said detector to thereby adjust said color output.

9. A lighting and control system according to claim 7, wherein each of said plurality of light emitting diode strings is coupled in series with a respective electronically controlled switch, said respective electronically controlled switch arranged to alternately, responsive to said detector, allow the flow of a sufficient current through the respective light emitting diode string to produce an optical output of said particular one of said plurality of colors, and block the flow of said sufficient current through the respective light emitting diode string, and wherein said detector is operative to pulse width modulate each of said plurality of light emitting diode strings via said respective electronically controlled switch to thereby adjust said color output.

10. A method of powering and controlling a luminaire over a pair of alternating current carrying wires, said method comprising:

receiving a first non-momentary input reflective of a desired light intensity;

receiving a second non-momentary input reflective of a desired light color;

gating a portion of a first polarity of an alternating current power signal, said portion of said first polarity responsive to said received first non-momentary input;

gating a portion of a second polarity of the alternating current power signal, said second polarity opposite said first polarity, said portion of said second polarity responsive to said received second non-momentary input;

detecting the amount of said gating of said first polarity;

detecting the amount of said gating of said second polarity;

powering a luminaire with said gated alternating current power signal;

controlling the intensity of light output by said powered luminaire responsive to said detected amount of said gating of said first polarity; and controlling the output color of said powered luminaire responsive to said detected amount of said gating of said second polarity.

11. A method according to claim 10, further comprising:

limiting said gating of said portion of said first polarity and said portion of said second polarity so as to provide a predetermined minimum amount of power to said powered luminaire.

12. A method according to claim 10, wherein said gating a portion of said first polarity comprises blocking the flow of said alternating current power signal until the voltage of said alternating current power signal of said first polarity has exceeded a threshold, said threshold responsive to said received first non-momentary input.

13. A method according to claim 10, wherein said gating a portion of said second polarity comprises blocking the flow of said alternating current power signal until the voltage of said alternating current power signal of said second polarity has exceeded a threshold, said threshold responsive to said received second non-momentary input.

14. A method according to claim 10, wherein said powering the luminaire comprises:

rectifying said gated alternating current power signal to produce a direct current signal having a first voltage; and converting said produced direct current signal to a direct current signal having a second voltage, and wherein said controlling the luminous intensity comprises adjusting the value of said second voltage.

15. A method according to claim 10, wherein said controlling the output color of said powered luminaire comprises pulse width modulating constituent colored light emitting elements of said powered luminaire so as to produce said desired light color.

16. A lighting unit arranged to be powered from a gated alternating current power over a pair of power carrying wires, the lighting unit comprising:

a detector arranged on each of a first polarity and a second polarity of the gated alternating current power, said first polarity opposing said second polarity, said detector arranged to determine the amount of said gating of said first polarity and the amount of said gating of said second polarity and output a first control signal reflective of said determined amount of said gating of said first polarity and a second control signal reflective of said determined amount of said gating of said second polarity; and a luminaire exhibiting a variable output light intensity and a variable output color, said light intensity adjustable responsive to said output first control signal, and said output color adjustable responsive to said second control signal.

17. A lighting unit according to claim 16, further comprising a direct current to direct current converter exhibiting an output voltage, said output voltage responsive to said detector to thereby adjust said light intensity of said luminaire.

18. A lighting unit according to claim 17, wherein said luminaire comprises a plurality of light emitting diode strings arranged to receive power from said direct current to direct current converter, each of said plurality of light emitting diode strings outputting light of a particular one of a plurality of colors, said color output of said luminaire comprising a mix of the color outputs of said plurality of light emitting diode strings.

19. A lighting unit according to claim 18, wherein each of said plurality of light emitting diode strings is respectively pulse width modulated responsive to said detector to thereby adjust said color output.

20. A lighting unit according to claim 18, wherein each of said plurality of light emitting diode strings is coupled in series with a respective electronically controlled switch, said respective electronically controlled switch arranged to alternately, responsive to said detector, allow the flow of a sufficient current through the respective light emitting diode string to produce an optical output of said particular one of said plurality of colors, and block the flow of said sufficient current through the respective light emitting diode string, and wherein said detector is arranged to pulse width modulate each of said plurality of light emitting diode strings via said respective electronically controlled switch to thereby adjust said color output.

* * * * *